US008199183B2

(12) United States Patent
Hosen et al.

(10) Patent No.: US 8,199,183 B2
(45) Date of Patent: Jun. 12, 2012

(54) LASER PRINTING SYSTEM AND LASER PRINTING METHOD

(75) Inventors: Hiroshi Hosen, Kawasaki (JP); Shunji Morikazu, Joyo (JP)

(73) Assignee: Suntory Holdings Limited, Osaka-shi, Osaka (JP)

( * ) Notice: Subject to any disclaimer, the term of this patent is extended or adjusted under 35 U.S.C. 154(b) by 640 days.

(21) Appl. No.: 12/257,751

(22) Filed: Oct. 24, 2008

(65) Prior Publication Data

US 2009/0109275 A1 Apr. 30, 2009

(30) Foreign Application Priority Data

Oct. 29, 2007 (JP) ..... 2007-280657

(51) Int. Cl.
*B41J 2/435* (2006.01)
*B65B 13/02* (2006.01)
*B65B 13/18* (2006.01)

(52) U.S. Cl. ..... 347/262; 347/264

(58) Field of Classification Search ..... 347/224, 347/225

See application file for complete search history.

(56) References Cited

U.S. PATENT DOCUMENTS

| | | | | |
|---|---|---|---|---|
| 6,614,023 | B2 * | 9/2003 | Focke et al. | 250/319 |
| 6,915,895 | B2 * | 7/2005 | Morikazu et al. | 198/468.11 |
| 7,055,350 | B2 * | 6/2006 | Bonnain et al. | 70/97 |
| 2009/0211464 | A1 * | 8/2009 | Till | 100/2 |

FOREIGN PATENT DOCUMENTS

| | | | |
|---|---|---|---|
| CN | 2134974 | | 6/1993 |
| CN | 2723100 | | 9/2005 |
| JP | 59-134122 | A | 8/1984 |
| JP | 9-123607 | | 5/1997 |
| JP | 9-175013 | | 7/1997 |
| JP | 10-138641 | | 5/1998 |
| JP | 2002-361937 | A | 12/2002 |
| JP | 2003-340578 | A | 12/2003 |
| JP | 2006-103115 | A | 4/2006 |
| TW | 520337 | B | 2/2003 |
| WO | WO 03/024805 | * | 3/2003 |

OTHER PUBLICATIONS

Machine-generated transaltion of JP 2003-340578, published on Dec. 2003.*

* cited by examiner

*Primary Examiner* — Huan Tran
(74) *Attorney, Agent, or Firm* — Drinker Biddle & Reath LLP

(57) ABSTRACT

A laser printing system comprising a conveyor for conveying a group of containers, a container group packaging device for packaging a group of containers by a base material at the conveyor, if a conveyance speed when the group of containers packaged by the base material reaches a first region is smaller than a conveyance speed a predetermined time before the packaged group of containers packaged by the base material reaches the first region, the conveyor conveying the packaged group of containers by the conveyance speed when reaching the first region, and a laser printing device for laser printing the base material of the packaged group of containers when the packaged group of containers reaches a second region positioned downstream from the first region at the conveyor. Due to this, the identical base material is prevented from being printed on a plurality of times. Further, this may also include an end signal emitter for emitting a printing end signal after the base material is printed on.

10 Claims, 5 Drawing Sheets

| NUMBER OF CONTAINERS | CONVEYANCE SPEED COMMAND VALUE |
|---|---|
| $NA_1$ | $VC_1$ |
| ⋮ | ⋮ |
| $NA_n$ | $VC_m$ |

| NA \ NB | | | |
|---|---|---|---|
| $VC_{11}$ | $VC_{12}$ | - - - - - | $VC_{1n}$ |
| $VC_{21}$ | | | ⋮ |
| ⋮ | | | |
| $VC_{m1}$ | - - - - - - - - - | | $VC_{mn}$ |

LASER PRINTING SYSTEM AND LASER PRINTING METHOD

RELATED APPLICATION DATA

This application claims priority under 35 U.S.C. §119 and/or §365 to Japanese Application No. 2007-280657, filed Oct. 29, 2007, the entire contents of which are incorporated herein by reference.

BACKGROUND OF THE INVENTION

1. Field of the Invention

The present invention relates to a laser printing method for laser printing a multipack paper packaging material or other base material for packaging a plurality of containers and a laser printing system for working that method.

2. Description of the Related Art

Can containers filled with beverages, for example, beer and other alcoholic beverages are sometimes packaged together by a paper packaging material or other base material and sold as multipack packages. The can containers are printed with the best consumed by date of the beverage filled in the can containers. This printing often is performed by employing the ink jet system of spraying liquid ink to the can bottoms by a nozzle for printing. Further, when the beverage filled into the can containers is an alcoholic beverage, a warning like "alcoholic beverage" is often printed. This printing is often performed by employing a system of 3D printing embossing the can lid so as to enable the fact that the beverage filled in the can container is an alcoholic beverage to be recognized even when the purchaser is sight impaired.

On the other hand, the paper packaging material or other base material for packaging the containers itself is often not printed with the above best consumed by date. Further, the warning is often displayed printed in advance on the base material surface.

For this reason, when the purchaser is sight impaired, he or she cannot determine by touch if the beverage to be purchased is before the best consumed by date or that it is an alcoholic beverage, so might purchase beverages past the best consumed by date or alcoholic beverages mistaken for nonalcoholic beverages. To avoid such a situation, the base material of the multipack package itself is preferably also given the best consumed by date and/or the warning. However, in this case, 3D printing is necessary to enable the sight impaired to read it.

To give 3D printing, the method of 3D printing by using a laser printing system which makes ink of a layer on the surface side of a plurality of layers partially melt by heat may be considered. Such a laser printing system is disclosed in Japanese Patent Publication (A) No. 10-138641, Japanese Patent Publication (A) No. 9-175013, and Japanese Patent Publication (A) No. 9-123607.

In this regard, to display the best consumed by date or "alcoholic beverage" on a multipack package, it is preferable to first package a plurality of can containers together to form a multipack package, then print on it. Therefore, the above-mentioned laser printing system is preferably installed in the middle of the conveyor over which the multipack packages are conveyed and near the downstream side of the conveyor of the multipack packaging machine packaging a plurality of can containers together to form multipack packages. On the other hand, the conveyor is connected at its upstream side to an accumulating device in which a plurality of can container are temporarily stored and at its downstream side to a caser for placing the multipack packages in boxes.

The conveyance speed of a conveyor is controlled by a control system and changes in accordance with the states of the upstream side accumulating device and downstream side caser. For example, when the number of containers in the accumulating device is large and when the number of multipack packages before being placed into boxes at the caser is small, the conveyance speed of the conveyor is made larger. Conversely, when the number of containers in the accumulating device is small and when the number of multipack packages before being packed into boxes at the caser is large, the conveyance speed of the conveyor is made smaller or the conveyor is stopped in some cases. Further, when the caser begins operating abnormally, the conveyor may sometimes make an emergency stop.

In this way, the conveyance speed of a conveyor changes, so situations may be envisioned where the conveyor and multipack package stop at the start position of laser printing. In this case, the laser printing system will repeatedly print on the identical multipack package several times, so the identical multipack package will be partially or completely printed twice with the same words. Such a multipack package will be judged as failing in the later step of inspection of appearance.

The present invention was made in consideration of this situation and has as its object the provision of a laser printing method enabling prevention of the same base material being printed a plurality of times and a laser printing system for working this method.

SUMMARY OF THE INVENTION

According to the first aspect for achieving the above object, there is provided a laser printing method comprising the step of conveying a group of containers by a conveyor; packaging the group of containers by a base material at the conveyor; if a conveyance speed when the packaged group of containers packaged by the base material reaches a first region is smaller than a conveyance speed a predetermined time before the packaged group of containers packaged by the base material reaches the first region, conveying the packaged group of containers by the conveyance speed when reaching the first region; and laser printing the base material of the packaged group of containers when the packaged group of containers reaches a second region positioned downstream from the first region in a conveyance direction of the conveyor.

That is, in the first aspect, if the conveyance speed when a packaged group of containers reaches a first region is smaller than a conveyance speed a predetermined time before, the conveyance speed is not changed. For this reason, even when the packaged group of containers is conveyed through a second region for printing, the conveyance speed is not changed. Therefore, the printing can be ended without the packaged group of containers stopping at the second region. For this reason, the base material of the identical packaged group of containers is prevented from being printed on a plurality of times.

According to a second aspect, there is provided a laser printing method comprising the steps of conveying a group of containers by a conveyor; packaging the group of containers by a base material at the conveyor; if a conveyance speed when the packaged group of containers packaged by the base material reaches a first region is smaller than a conveyance speed a predetermined time before the packaged group of containers packaged by the base material reaches the first region, conveying the packaged group of containers by a predetermined conveyance speed; and laser printing the base material of the packaged group of containers when the packaged group of containers reaches a second region positioned downstream from the first region in a conveyance direction of the conveyor.

That is, in the second aspect, if the conveyance speed when the packaged group of containers reaches the first region is smaller than the conveyance speed of a predetermined time before, the conveyance speed is made that predetermined conveyance speed. For this reason, when the packaged group of containers is conveyed through the second region for printing, the conveyance speed will remain unchanged at the predetermined conveyance speed. Therefore, the printing can be ended without the packaged group of containers stopping in the second region. For this reason, the base material of the identical packaged group of containers being printed a plurality of times can be prevented.

According to a third aspect, there is provided the first aspect or the second aspect further comprising the step of emitting a printing end signal after the base material is printed.

That is, in the third aspect, it is possible to reliably prevent the identical base material from being printed on again by emitting a printing end signal.

According to a fourth aspect, there is provided a laser printing method comprising the step of conveying a group of containers by a conveyor; packaging the group of containers by a base material at the conveyor; laser printing the base material of the packaged group of containers when the group of containers packaged by the base material reaches a printing region; and emitting a printing end signal after the base material is printed.

That is, in the fourth aspect, it is possible to reliably prevent the identical base material from being printed on again by emitting a printing end signal.

According to a fifth aspect, there is provided a laser printing system comprising a conveyor for conveying a group of containers; a container group packaging device for packaging the group of containers by a base material at the conveyor; wherein if a conveyance speed when the group of containers packaged by the base material reaches a first region is smaller than a conveyance speed a predetermined time before the packaged group of containers packaged by the base material reaches the first region, the conveyor conveying the packaged group of containers by the conveyance speed when reaching the first region; and a laser printing device for laser printing the base material of the packaged group of containers when the packaged group of containers reaches a second region positioned downstream from the first region in the conveyance direction of the conveyor.

That is, in the fifth aspect, if the conveyance speed when the packaged group of containers reaches the first region is smaller than the conveyance speed a predetermined time before, the conveyance speed is not changed. For this reason, even when the packaged group of containers is conveyed through the second region for printing, the conveyance speed remains unchanged. Therefore, the printing can be ended without the packaged group of containers stopping in the second region. For this reason, the base material of the identical packaged group of containers is prevented from being printed on a plurality of times.

According to the sixth aspect, there is provided a laser printing system comprising a conveyor for conveying a group of containers; a container group packaging device for packaging the group of containers by a base material at the conveyor; wherein if the conveyance speed when the packaged group of containers packaged by the base material reaches a first region is smaller than the conveyance speed a predetermined time before the packaged group of containers packaged by the base material reaches the first region, the conveyor conveys the packaged group of containers by the predetermined conveyance speed; and a laser printing device for laser printing the base material of the packaged group of containers when the packaged group of containers reaches a second region positioned downstream from the first region in the conveyance direction of the conveyor.

That is, in the sixth aspect, if the conveyance speed when the packaged group of containers reaches the first region is smaller than the conveyance speed of a predetermined time before, the conveyance speed is made the predetermined conveyance speed. For this reason, even when the packaged group of containers is conveyed through the second region for printing, the conveyance speed remains unchanged as the predetermined conveyance speed. Therefore, the printing can be ended without the packaged group of containers stopping in the second region. For this reason, the base material of the identical packaged group of containers is prevented from being printed on a plurality of times.

According to a seventh aspect, there is provided the fifth or sixth aspect further comprising an end signal emitter means for emitting a printing end signal after the base material has been printed on.

That is, in the seventh aspect, it is possible to reliably prevent the identical base material from being printed on again by emitting a printing end signal.

According to an eighth aspect, there is provided a laser printing system comprising a conveyor for conveying a group of containers, a container group packaging device for packaging the group of containers by a base material at the conveyor, a laser printing device for laser printing the base material of the packaged group of containers when the group of containers packaged by the base material reaches a printing region; and an end signal emitter for emitting a printing end signal after the base material has been printed.

That is, in the eighth aspect, it is possible to reliably prevent the identical base material from being printed on again by emitting a printing end signal.

These and other objects, features. and advantages of the present invention will be more apparent in light of the detailed description of exemplary embodiments thereof as illustrated by the drawings.

DESCRIPTION OF THE PREFERRED EMBODIMENTS

Below, embodiments of the present invention will be explained with reference to the attached drawings. In the following drawings, similar members are assigned similar reference notations. To facilitate understanding, these drawings are suitably changed in scale.

Figure 1:
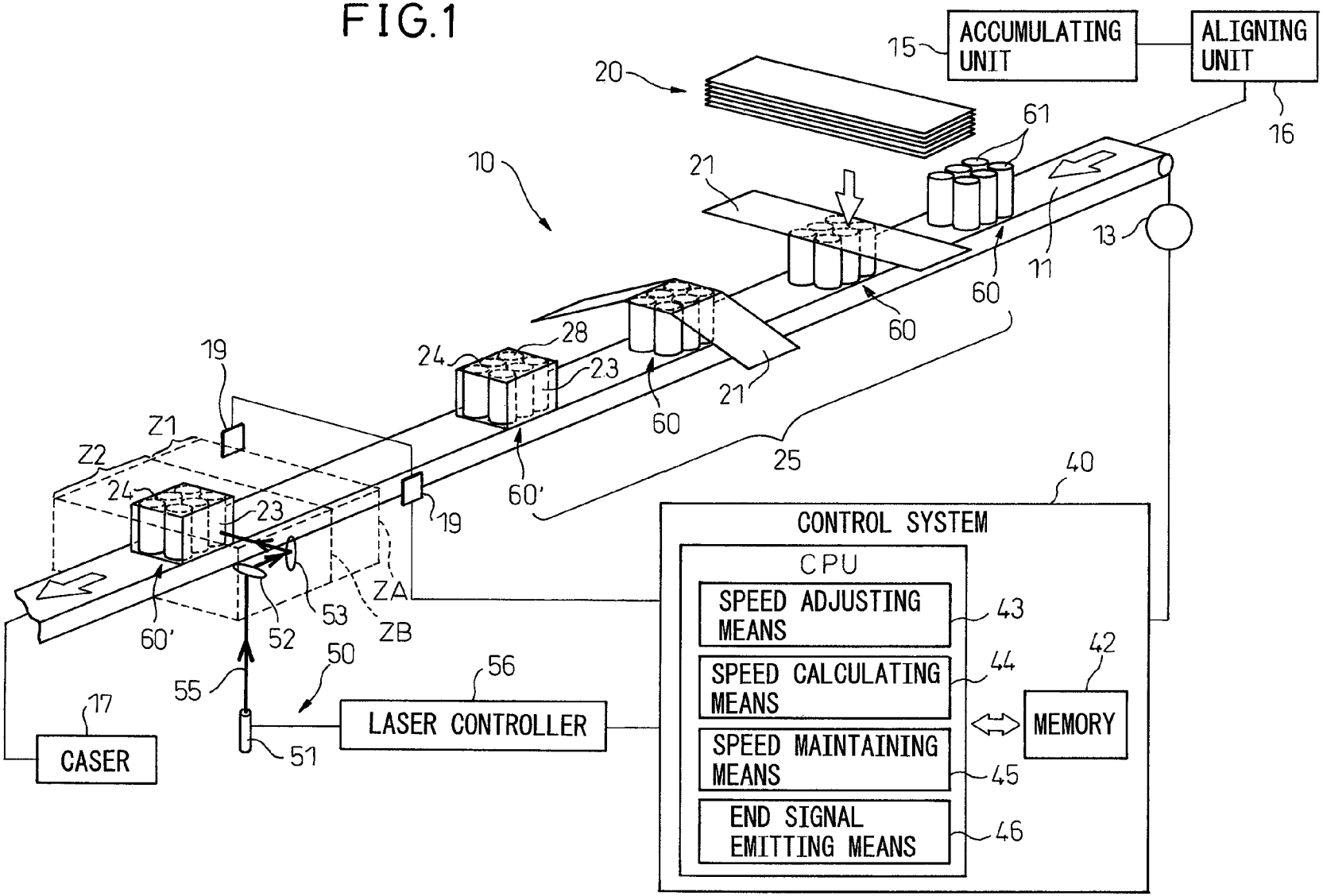
FIG. 1 is a schematic perspective view of a laser printing system according to the present invention.

FIG. 1 is a schematic perspective view of a laser printing system according to the present invention. As shown in FIG. 1, the laser printing system 10 is arranged downstream of an aligning unit 16 in a conveyance direction of a conveyor 11. Further, the aligning unit 16 is arranged downstream of an accumulating unit 15.

While not shown, the accumulating unit 15 is further coupled with a further upstream side container processing system, for example, a warmer for preventing condensation at containers filled and sealed with a beverage. The accumulating unit 15 functions to temporarily store the plurality of containers fed from the container processing system positioned upstream from the accumulating unit 15 when unforeseen trouble occurs at a unit downstream from the accumulating unit 15 and the unit stops operating etc.

The aligning unit 16 positioned downstream from the accumulating unit 15 aligns a plurality of self standing containers 61, for example, six containers 61, in for example two rows and three columns and feeds them to the conveyor 11. Below, in this specification, the plurality of containers 61 aligned by the aligning unit 16 in for example two rows and three columns will be called a "group of containers 60". Further, these accumulating unit 15 and aligning unit 16 are known, so detailed explanations will be omitted. Note that the accumulating unit 15 and aligning unit 16 may also be parts of the laser printing system 10.

As shown in FIG. 1, the laser printing system 10 includes a paper packaging material feed unit 20 for holding a plurality of paper packaging materials 21 and feeding a single paper packaging material 21 to the conveyor 11. Further, the laser printing system 10 includes a packaging unit 25 for folding the fed paper packaging material 21 to package the group of containers 60 and form the multipack package 60'. These paper packaging material feed unit 20 and packaging unit 25 are successively arranged in the conveyance direction of the conveyor 11 of the laser printing system 10.

The paper packaging material 21 fed from the paper packaging material feed unit 20 has dimensions suitable for packaging the group of containers 60. At the edges of the paper packaging material 21, projections, slits, etc. are formed for use for surrounding and holding the group of containers 60, but these projections, slits, etc. are not shown for the purpose of simplification.

Further, as shown in FIG. 1, in the present invention, a printing unit 50 is provided at the downstream side of the packaging unit 25. The printing unit 50 includes a laser emitter 51, a laser controller 56 for controlling the laser emitter 51, and mirrors 52, 53 for reflecting a laser beam emitted from the laser emitter 51 and directing it to a predetermined position on the paper packaging material 21. These mirrors 52, 53 are rotatably supported and can be conveyed in the conveyance direction of the conveyor 11 and the direction vertical to the conveyance direction.

As shown in FIG. 1, there is a printing region Z2 where the printing unit 50 can print on the paper packaging material 21. The upstream end of the printing region Z2 is the printing start position ZB where the printing of the paper packaging material 21 is started. Further, upstream of the printing region Z2, the printing preparation region Z1 is present adjacent to the printing region Z2. The upstream end of the printing region Z1 is the printing preparation start position ZA for starting the printing preparations. When the multipack package 60' passes through the printing preparation region Z1, it is not printed and only the conveyance speed of the conveyor 11 is adjusted. Further, upstream of the printing preparation region Z1, a sensor 19 for detecting a multipack package 60' is arranged. Note that while the conveyor 11 rotates, caution is required that the printing preparation region Z1, printing region Z2, printing preparation start position ZA, and printing start position ZB do not move.

As shown in FIG. 1, downstream of the conveyor 11, a caser 17 for packing a predetermined number of multipack packages 60' in a carton box (not shown) is provided. The caser 17 and accumulating unit 15 are connected to a control system 40. Further, as shown in FIG. 1, a rotary encoder 13 interlocked with a pulley of the conveyor 11 is also connected to the control system 40. Similarly, a sensor 19 and a laser controller 56 are also connected to the control system.

The control system 40 is a digital computer provided with a CPU 41 and a memory 42 and controls the laser printing system 10 as a whole. As can be seen from FIG. 1, the CPU 41 performs the functions of the speed adjusting means 43 for adjusting the conveyance speed of the conveyor 11, the speed calculating means 44 for calculating the conveyance speed detection value VD of the conveyor 11, the speed maintaining means 45 for maintaining the conveyance speed of the conveyor 11 at a certain value, and the end signal emitting means 46 for emitting a printing end signal to the laser controller 56 when the paper packaging material 21 finishes being printed. Further, the memory 42 provided at the control system 40 stores various programs, data, and the later explained maps etc. of the laser printing system 10.

Figure 2:
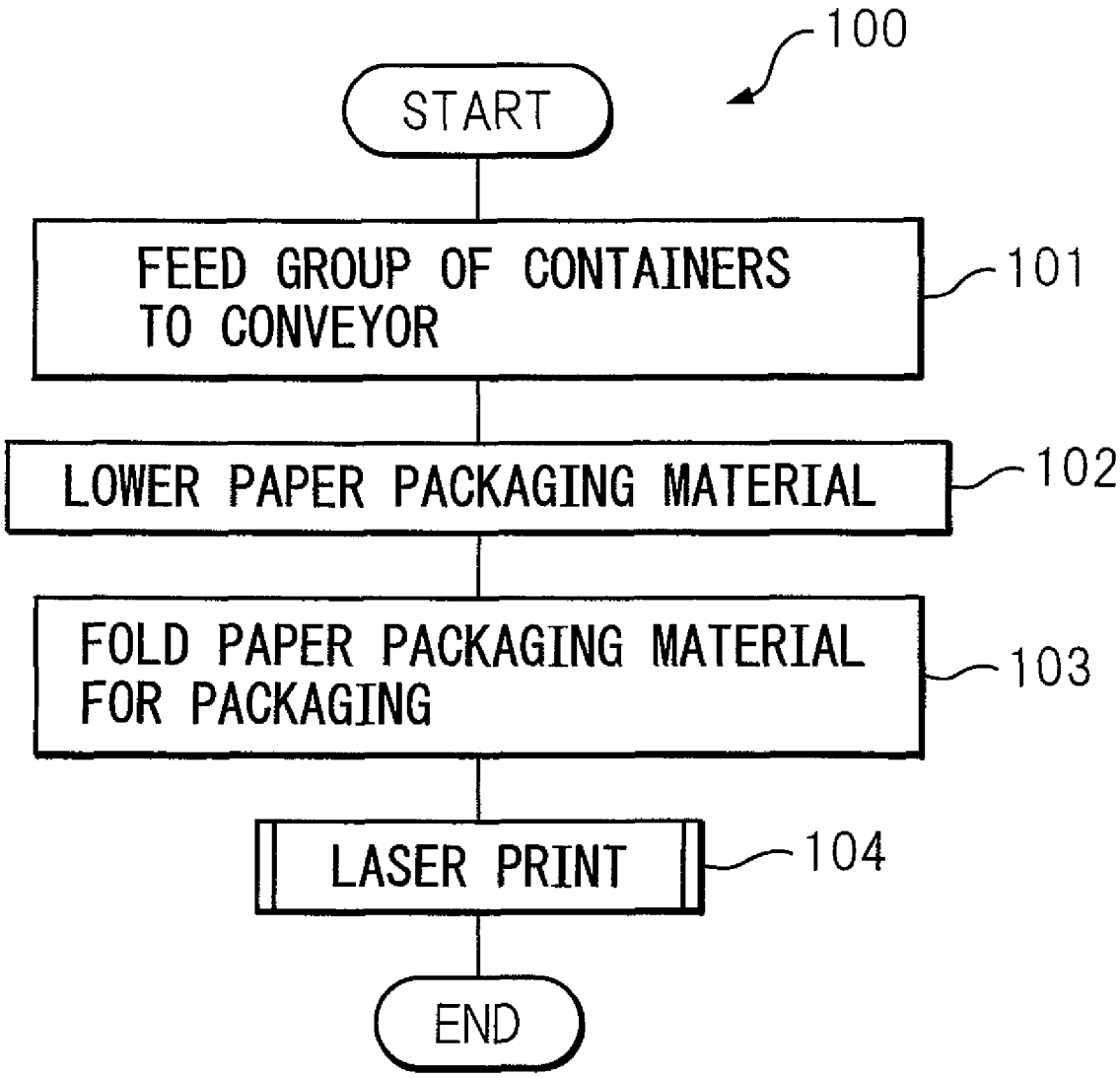
FIG. 2 is a flow chart showing the operation of a laser printing system shown in FIG. 1.

FIG. 2 is a flow chart showing the operation of the laser printing system shown in FIG. 1. Below, the operation of the laser printing system 10 based on the present invention will be explained with reference to FIG. 1 and FIG. 2.

At step 101, the group of containers 60 passing through the accumulating unit 15 and aligned by the aligning unit 16 is fed on to the conveyor 11 of the laser printing system 10. The conveyance speed of the conveyor 11 is adjusted in accordance with the conveyance speed command value VC.

Figures 3A, 3B, 4:
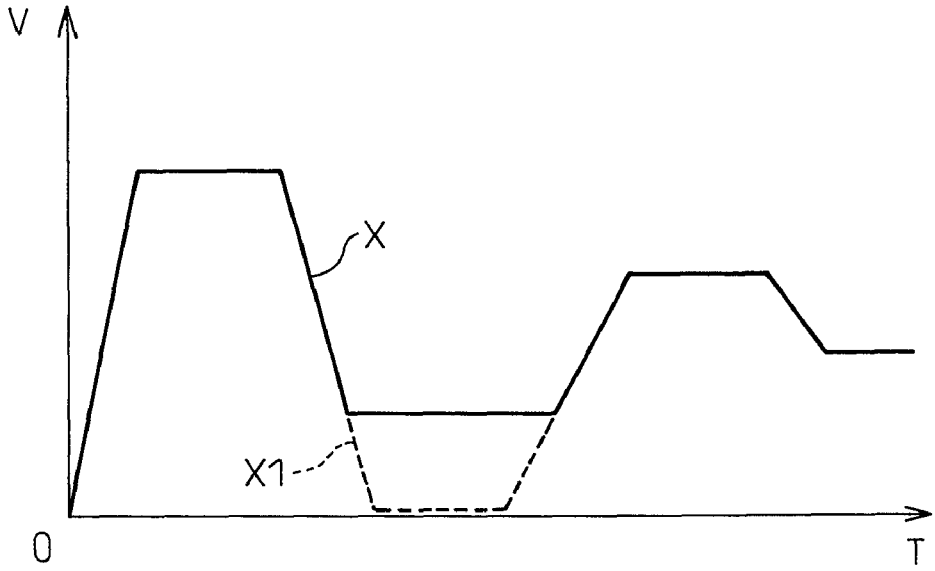
FIG. 3*a* is a view showing a first map of a conveyance speed command value VC.
FIG. 3*b* is a view showing a second map of a conveyance speed command value VC.
FIG. 4 is a view showing the relationship of a conveyance speed command value VC or a conveyance speed detection value VD and time.

FIG. 3*a* and FIG. 3*b* are views showing maps of the conveyance speed command value VC. These maps are stored in the memory 42 of the control system 40. In the map shown in FIG. 3*a*, the conveyance speed command value VC is predetermined in accordance with the number NA of containers in the accumulating unit 15. In FIG. 3*a*, if the number NA of containers becomes larger, the conveyance speed command value VC of the conveyor 11 becomes larger.

In the map shown in FIG. 3*b*, the conveyance speed command value VC is predetermined as a function of the number NA of containers in the accumulating unit 15 and the number NB of multipack packages 60' in the caser 17. In the map shown in FIG. 3*b*, when the number NA of containers in the accumulating unit 15 is large and when the number NB of multipack packages 60' in the caser 17 is small, the conveyance speed command value VC becomes larger.

The speed adjusting means 43 adjusts the conveyance speed of the conveyor 11 based on the map of the conveyance speed command value VC shown in FIG. 3*a* or FIG. 3*b*. For example, the conveyance speed of the conveyor 11 shows the behavior as shown by the solid line X in FIG. 4.

Again referring to FIG. 2, when the group of containers 60 passes below the paper packaging material feed unit 20, a single paper packaging material 21 descends from the paper packaging material feed unit 20 and, as shown in FIG. 1, is placed on the group of containers 60 (step 102).

Next, at step 103, the packaging unit 25 folds the paper packaging material 21 by a known technique to surround the group of containers 60. When the paper packaging material 21 completely packages the group of containers 60, as shown in FIG. 1, a multipack package 60' is formed. As can be seen from FIG. 1, the top part 28 of the multipack package 60' and the side parts 23, 24 parallel to the conveyance direction and the bottom (not shown) are parts of the paper packaging material 21. On the contrary, the ends of the multipack package 60' vertical to the conveyance direction are not covered by the paper packaging material 21.

When the multipack package 60' is further conveyed on the conveyor 11, the multipack package 60' is detected by a sensor 19. The control system 40 recognizes the rotational angle at the rotational position of the rotary encoder 13 when the multipack package 60' is detected by the sensor 19 as the zero degree rotational angle.

Figure 5:
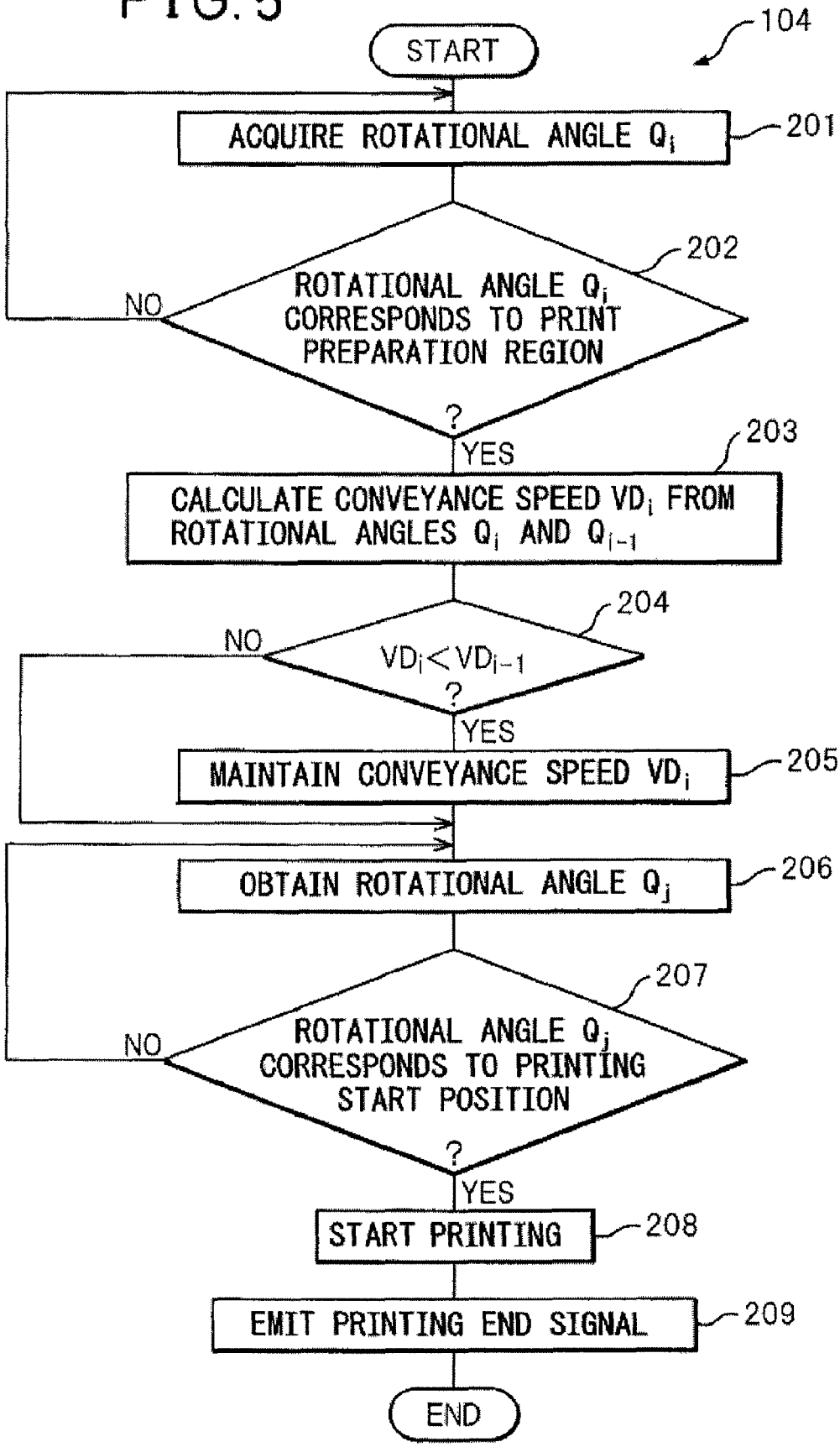
FIG. 5 is a flow chart showing a laser printing action.

Next, details of the laser printing action at step 104 of FIG. 2 will be explained with reference to FIG. 5. The rotational angle $Q_i$ (i=1 to n, n is a natural number) of the rotary encoder 13 is acquired every predetermined unit time and successively stored in the memory 42 of the control system 40 (step 201).

Next, at step 202, it is judged if the acquired rotational angle $Q_i$ corresponds to the printing preparation start position ZA of the printing preparation region Z1. The distance between the sensor 19 and the printing preparation start position ZA corresponds to a specific rotational angle of the rotary encoder 13, so at step 202, it is judged if the rotational angle $Q_i$ of the rotary encoder 13 is a specific rotational angle.

When the rotational angle $Q_i$ becomes the specific rotational angle, it is judged that the multipack package 60' has entered the printing preparation region Z1 and the routine proceeds to step 203. On the other hand, when it is judged that the rotational angle $Q_i$ does not correspond to the printing preparation start position ZA of the printing preparation region Z1, the routine returns to step 201 and repeats the processing.

At step 203, the speed calculating means 44 of the control system 40 calculates the conveyance speed detection value $VD_i$ based on the rotational angle $Q_i$ of the rotary encoder 13 and the rotational angle $Q_{i-1}$ stored in the memory 42 immediately before this rotational angle $Q_i$. The reason why the conveyance speed detection value $VD_i$ is calculated regardless of the existence of the conveyance speed command value VC is to enable more accurate printing based on the more accurate conveyance speed. Specifically, by calculating the circumferential direction distance of the rotary encoder 13 from the two rotational angles $Q_i$, $Q_{i-1}$ and dividing the calculated circumferential direction distance by a predetermined unit time, the conveyance speed detection value $VD_i$ is calculated.

Next, at step 204, it is judged if the conveyance speed detection value $VD_i$ is smaller than the immediately previous conveyance speed detection value $VD_{i-1}$ calculated in the same way. If the conveyance speed detection value $VD_i$ is smaller than the conveyance speed detection value $VD_{i-1}$, it is deduced that the conveyance speed of the conveyor 11 tends to fall.

In such a case, as shown by the broken line X1 in FIG. 4, when the multipack package 60' is conveyed, the conveyance speed becomes zero and the multipack package 60' may stop at the printing start position ZB. Further, at the location just slightly beyond the printing start position ZB, although the conveyance speed becomes zero, the backlash of the conveyor 11 may cause the multipack package 60' to return to the printing start position ZB. When the conveyance speed detection value $VD_i$ is smaller than the immediately previous conveyance speed detection value $VD_{i-1}$, at step 205, the speed maintaining means 45 maintains the operation of the conveyor 11 at a predetermined conveyance speed V larger than zero. Due to this, the conveyance speed of the conveyor 11 is maintained at the conveyance speed V until finishing passing through the printing region Z2 without being affected by the number of containers NA at the accumulating unit 15 and the number NB of multipack packages 60' at the caser 17.

On the other hand, at step 204, when the conveyance speed detection value $VD_i$ becomes smaller than the previous conveyance speed detection value $VD_{i-1}$, the conveyance speed of the multipack package 60' continues to change as explained above according to the conveyance speed command value VC. Of course, even when the conveyance speed detection value $VD_i$ is not smaller than the previous conveyance speed detection value $VD_{i-1}$, the conveyance speed of the conveyor 11 may be maintained at the conveyance speed V.

Next, at step 206, the newest rotational angle $Q_j$ (j=1 to n, n is a natural number, j>i) is obtained. Further, at step 207, in the same way as the case of the above-mentioned step 202, it is judged if the obtained rotational angle $Q_j$ corresponds to the printing start position ZB of the printing region Z2. When the rotational angle $Q_j$ corresponds to the printing start position ZB, at step 208, the printing of the base material 21 of the multipack package 60' is started. When the printing is started, the desired words instantaneously finish being printed. Note that when the rotational angle $Q_j$ does not correspond to the printing start position ZB of the printing region Z2, the routine returns to step 206 and repeats the processing.

At the time of laser printing, the laser emitter 51 of the printing unit 50 emits a laser beam 55. The mirrors 52, 53 reflect this to the one side part 23 of the multipack package 60', that is, part of the paper packaging material 21.

Figure 6A:
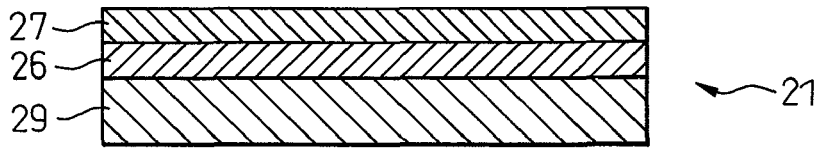
FIG. 6*a* is a partial cross-sectional view of a paper packaging material.
Figure 6B:
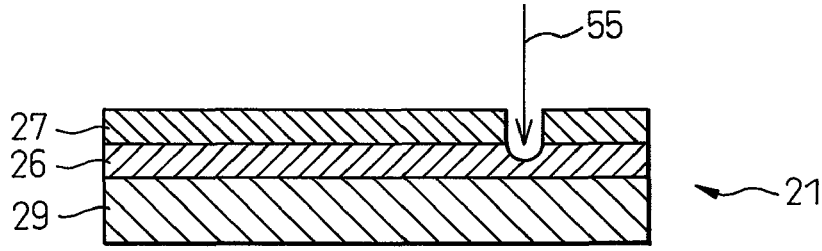
FIG. 6*b* is another partial cross-sectional view of a paper packaging material.

FIG. 6*a* and FIG. 6*b* are partial cross-sectional views of a paper packaging material. As shown by these figures, at part of the paper packaging material 21 (printed location), the first printed layer 27 (ink layer) and second printed layer 26 (coat layer) are laminated on the liner layer 29.

These first printed layer 27 and second printed layer 26 are comprised of mutually differing colors. For example, the first printed layer 27 is black and the second printed layer 26 is white. The inks used for these first printed layer 27 and second printed layer 26 are not particularly limited, but may be any of a polyamide-based resin, nitrocellulose-based resin, polyester-based resin, polyacryl-based resin, or vinyl chloride-vinyl acetate-based resin. These materials are suitably selected in accordance with the objective.

When the laser beam 55 is emitted to the first printed layer 27 at the side part 23, as shown in FIG. 6*b*, the part of the first printed layer 27 to which it was emitted is removed and the corresponding part of the second printed layer 26 is exposed. Due to this, the exposed part can be discerned from the outside. Next, the mirrors 52, 53 are moved and the laser beam 55 continues to be emitted, whereby the desired words, for example, the best consumed by date or "alcoholic beverage", can be printed 3D. It will be understood that a similar technique may be used to form Braille at the side part of the multipack package 60'.

When the laser printing is started at step 208, the end signal emitting means 46 sends a printing end signal to the laser controller 56 to end the processing at step 209. Due to this, the identical multipack package 60' being again printed is reliably prevented. Further, as explained above, even if the multipack package 60' returns to the printing start position ZB due to backlash, it can be prevented from being printed on again.

Next, the multipack package 60' finishes passing through the printing region Z2 and is fed to a caser 17. At the caser 17, a predetermined number of multipack packages 60' are packed into a carton box (not shown) etc.

In this way, in the present invention, when it can be estimated at step 204 that the conveyance speed of the conveyor 11 has dropped, the conveyor 11 continues operating at a predetermined conveyance speed greater than zero. Due to this, the multipack package 60' stopping at the printing region Z2 is prevented. For this reason, the multipack package 60' never stops at the start position of the laser printing. Therefore, the printing is never performed twice. That is, in the present invention, the paper packaging material 21 of the identical multipack package 60' can be prevented from being printed on a plurality of times.

Note that in the embodiments explained with reference to the drawings, a laser type printing unit 50 is used for printing. However, there is no need to limit the invention to a laser type printing unit. Even employing another system, for example, an ink jet type printing unit, is included in the scope of the present invention.

Further, in not shown embodiments, when the conveyance speed detection value $VD_i$ is smaller than the previous conveyance speed detection value $VD_{i-1}$, the conveyance speed may be made a predetermined value larger than zero. Further, in a similar case, the conveyance speed may be made the average of the conveyance speed detection values $VD_i$, $VD_{i-1}$. Such a case as well clearly is included in the scope of the present invention.

Although the invention has been shown and described with exemplary embodiments thereof, it should be understood by those skilled in the art that the foregoing and various other changes, omissions, and additions may be made therein and thereto without departing from the scope of the invention.

The invention claimed is:

1. A laser printing method comprising the steps of:

conveying a group of containers by a conveyor;

packaging the group of containers by a base material at the conveyor;

if a conveyance speed when the packaged group of containers packaged by the base material reaches a first region is smaller than a conveyance speed a predetermined time before the packaged group of containers packaged by the base material reaches the first region, conveying the packaged group of containers by the conveyance speed when reaching the first region; and laser printing the base material of the packaged group of containers when the packaged group of containers reaches a second region positioned downstream from the first region in a conveyance direction of the conveyor.

2. A laser printing method comprising the steps of:

conveying a group of containers by a conveyor;

packaging the group of containers by a base material at the conveyor;

if a conveyance speed when the packaged group of containers packaged by the base material reaches a first region is smaller than a conveyance speed a predetermined time before the packaged group of containers packaged by the base material reaches the first region, conveying the packaged group of containers by a predetermined conveyance speed; and laser printing the base material of the packaged group of containers when the packaged group of containers reaches a second region positioned downstream from the first region in a conveyance direction of the conveyor.

3. A laser printing method as set forth in claim 1, further comprising the step of emitting a printing end signal after the base material is printed.

4. A laser printing method comprising the step of:

conveying a group of containers by a conveyor;

packaging the group of containers by a base material at the conveyor;

laser printing the base material of the packaged group of containers when the packaged group of containers packaged by the base material reaches a printing region; and emitting a printing end signal after the base material is printed.

5. A laser printing system comprising:

a conveyor for conveying a group of containers;

a container group packaging device for packaging the group of containers by a base material at the conveyor;

wherein if a conveyance speed when the group of containers packaged by the base material reaches a first region is smaller than a conveyance speed a predetermined time before the packaged group of containers packaged by the base material reaches the first region, the conveyor conveying the packaged group of containers by the conveyance speed when reaching the first region; and a laser printing device for laser printing the base material of the packaged group of containers when the packaged group of containers reaches a second region positioned downstream from the first region in the conveyance direction of the conveyor.

6. A laser printing system comprising:

a conveyor for conveying a group of containers;

a container group packaging device for packaging the group of containers by a base material at the conveyor;

wherein if the conveyance speed when the packaged group of containers packaged by the base material reaches a first region is smaller than the conveyance speed a predetermined time before the packaged group of containers packaged by the base material reaches the first region, the conveyor conveys the packaged group of containers by the predetermined conveyance speed; and a laser printing device for laser printing the base material of the packaged group of containers when the packaged group of containers reaches a second region positioned downstream from the first region in the conveyance direction of the conveyor.

7. A laser printing system as set forth in claim 5, further comprising an end signal emitter for emitting a printing end signal after the base material has been printed on.

8. A laser printing system comprising:

a conveyor for conveying a group of containers;

a container group packaging means for packaging the group of containers by a base material at the conveyor;

a laser printing device for laser printing the base material of the packaged group of containers when the packaged group of containers packaged by the base material reaches a printing region; and an end signal emitter for emitting a printing end signal after the base material has been printed.

9. A laser printing method as set forth in claim 2, further comprising the step of emitting a printing end signal after the base material is printed.

10. A laser printing system as set forth in claim 6, further comprising an end signal emitter for emitting a printing end signal after the base material has been printed on.

* * * * *